United States Patent [19]

Petersson et al.

[11] 4,330,249

[45] May 18, 1982

[54] CONTINUOUSLY OPERATING PRESS

[75] Inventors: Stefan Petersson, Skanör; Sven O. Alstad, Helsingborg, both of Sweden

[73] Assignee: Kockums Industri AB, Soderham, Sweden

[21] Appl. No.: 209,100

[22] Filed: Nov. 21, 1980

[30] Foreign Application Priority Data

Dec. 12, 1979 [SE] Sweden ..... 7910240

[51] Int. Cl.[3] ..... B28B 3/00

[52] U.S. Cl. ..... 425/329

[58] Field of Search ..... 425/329

[56] References Cited

U.S. PATENT DOCUMENTS

| | | | |
|---|---|---|---|
| 2,187,254 | 1/1940 | Wallace | 425/329 |
| 2,509,354 | 5/1950 | Jones et al. | 425/329 |
| 4,112,162 | 9/1978 | Casselbrant | 428/114 |

*Primary Examiner*—James R. Hall

*Attorney, Agent, or Firm*—Sughrue, Mion, Zinn, Macpeak and Seas

[57] ABSTRACT

A continuously working press for forming a continuously stringer (7) of compressible material, such as wood chips. For the purpose of pressing the stringer (7) in a vertical direction, the press includes upper and lower continuously moving endless press chains (8 and 9) formed by mutually linked support elements. For effecting active side-pressing of the stringer (7) an array of side-pressing blocks (19) are arranged on each side of the press chains (8, 9) and which blocks are suitably entrained for movement in the circular motion of the upper or lower chain. The side-pressing blocks (19) are displaceable in the transverse direction of the press chains (8, 9) and are guided during said displacement by guide means (23) which are conveyed by the support plates forming the press chains (8, 9).

8 Claims, 5 Drawing Figures

CONTINUOUSLY OPERATING PRESS

The present invention relates generally to a continuously operating press for forming a continuous length of compressible material, such as wood chips, said press being of the kind in which said length of compressible material, hereinafter referred to as the stringer, is pressed in a vertical direction by means of upper and lower, continuously moving endless press chains which are formed by mutually linked support elements and which co-act with upper and lower support structures. More specifically, the invention relates to a press of the aforementioned kind which is also provided with means for actively pressing the stringer in a lateral direction.

One example of a method in which it is desired to press a stringer on four sides thereof in two stages is the method of manufacturing the chip board beam described in U.S. Pat. No. 4,112,162. In the manufacture of this beam, a stringer of glue-coated chips comprising a plurality of part-stringers is first pressed in a vertical direction until the stringer obtains a thickness corresponding to the desired final thickness of the finished beam. In this way, the center part of the beam is given the required density, while the density of the edge regions of the beam is lower than that desired. Thus, it is necessary to compress the chip stringer in a horizontal direction in a further stage, in which stage the beam obtains the desired density at the edge portions thereof, and its final thickness. The pressure required to compress the stringer vertically in the pressing stage is about 0.5 MPa, while the pressure required to press the stringer in a horizontal direction is about 11 MPa, whereat a counter pressure of about 1 MPa must be exerted vertically on said stringer in order to prevent the thickness of the beam increasing.

Described in the Swedish Patent Specification No. 7504887-6 is a continuous press having side-restraining means. The purpose of these restraining means, however, is solely to prevent, in a passive manner, the plastic mass of the stringer from flowing outwardly. To this end, there are used support elements for a sealing belt which elements are circulating in a horizontal plane. These support elements are conveyed by friction between upper and lower horizontal press belts. An embodiment such as that described in said Swedish patent application cannot be used, however, for actively pressing the sides of a chip stringer with a force of the above-mentioned magnitude, as this requires, inter alia, large pressure forces and relatively long working strokes, which would render an embodiment as described in said Swedish patent application unsuitable. As a result of the long strokes, an arrangement in which the side-pressing elements circulate in a horizontal plane would require an unreasonably large space. The long strokes and the high pressure forces also require the side-pressing elements to be accurately guided. Further, the side-pressing elements must be driven exactly synchronously with the upper and lower press chains. Because of this it is not possible to rely solely on frictional forces to drive the side-pressing elements. Further, the use of a separate drive arrangement for the two side-restraining belts would create serious problems as regards synchronization.

Consequently, a main object of the invention is to provide a press of the kind described in the first paragraph in which press the sides of said stringer are pressed horizontally by means of accurately guided side-pressing elements which cause the least possible increase in the total space required by the press.

This object is achieved by means of the invention by providing the press, for actively pressing the sides of the stringer horizontally, with side-pressing blocks which are movable in the transverse direction of the press chains and which are guided for said horizontal movement by guide means which are conveyed by the support elements forming the press chains.

Preferably, the press comprises two arrays of side-pressing blocks which can be moved towards each other between the press chains. The side-pressing blocks are suitably conveyed in the circular motion of the upper or the lower press chain, whereat the blocks for effecting a transverse press movement co-act with guide rails arranged on the sides of the press chains.

For the purpose of guiding the side-pressing blocks, each of said blocks is connected in one embodiment with at least one shaft which is displaceably mounted on an associated support element. In accordance with a further embodiment, each side-pressing block is displaceably mounted on at least one shaft which projects out from an associated support element. Both embodiments afford accurate guiding of the movements of the side-pressing blocks, said blocks being caused to accompany the movement of the press chains formed by the support elements.

Suitably, each side-pressing block is connected, via at least one press arm, with at least one runner arranged to co-act with an associated guide rail. For smoother action on the side edges of the material stringer, each side-pressing block may be pivotally connected to two press arms arranged side by side, each of said press arms being connected to at least one runner arranged to co-act with an associated guide rail. Preferably, each press arm is connected to two runners, each arranged to co-act with a respective guide rail.

Further, it is preferred that said guide rails are so constructed that said pressing of the sides of the stringer is not commenced until the desired thickness of said stringer is substantially obtained, by compacting said stringer vertically.

Exemplary embodiments of the invention will now be described with reference to the accompanying drawings, in which FIG. 1 is a schematic axial sectional view through a continuous pre-press according to the invention.

Figure 1:
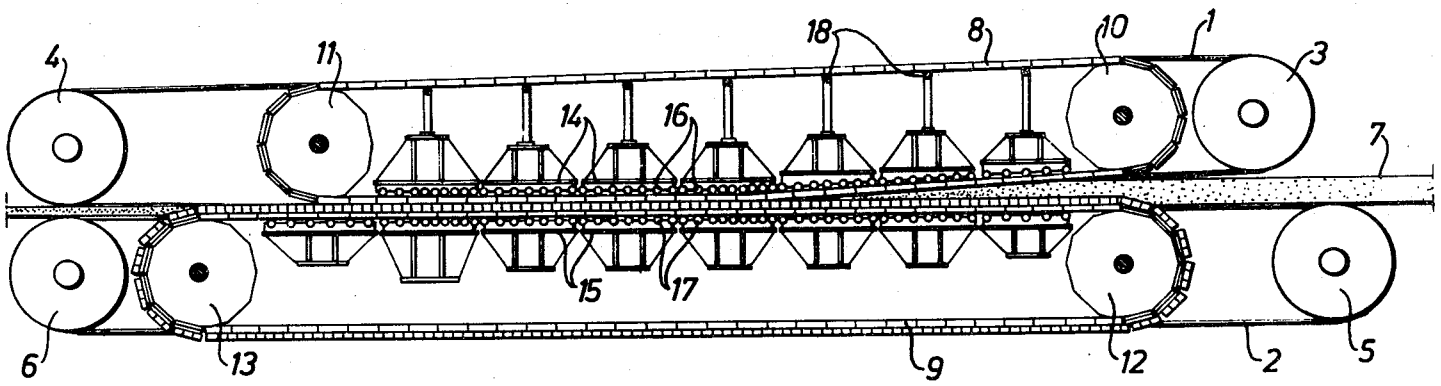

The pre-press shown in FIG. 1 comprises an upper and a lower endless press belt 1 and 2, respectively, which run continuously over associated guide rollers 3, 4 and 5, 6, respectively. The reference 7 identifies an incoming layer of material comprising for example wood chips, which is to be pressed on four sides thereof to form a chip stringer of accurately determined dimensions and density. In the pressing zone, the press belts 1 and 2 are supported by press chains 8 and 9, respectively, said press chains being formed by mutually linked support elements. The press chains 8 and 9 each pass over two rollers 10, 11 and 12, 13, respectively, of which rollers two are driven synchronously with one another. The press chains 8 and 9 cooperate in the pressing zone with rollers 16 and 17 arranged on support elements 14 and 15, respectively. As the press chain 8 returns, it is supported by upper support rollers 18. The vertically acting pressing force is obtained in a known manner, by decreasing the distance between the mutually opposite support elements 14 and 15 in the direction of travel of the belts 1 and 2.

Figure 2:
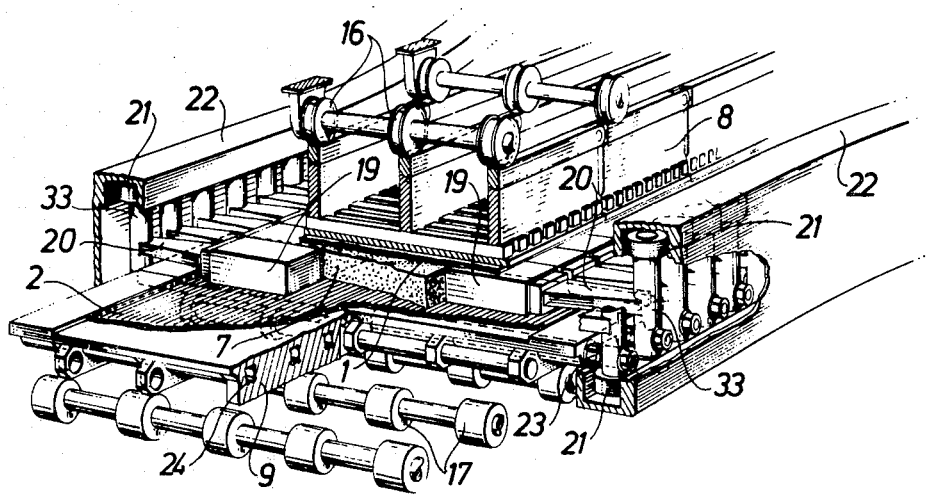
FIG. 2 is a sectional view in perspective through a part of a press constructed in accordance with the principle shown in FIG. 1, said view being in larger scale.

FIG. 2 is a sectional view in perspective through the pressing zone of a press constructed in accordance with FIG. 1, in which the links in the upper press chain 8 are constructed to permit the use of stationary dielectric electrodes for curing the adhesive when pressing glue-coated chips. It will be seen from this Figure that the layer of material 7 is also pressed laterally for which purpose an array of side-pressing blocks 19 is arranged on each side of the press belts 1 and 2 and which blocks project in between said press belts. Each of said side-pressing blocks 19 is connected, via a press arm 20, to a holder 33, which is provided with two runners 21 arranged to co-operate with other guide rails 22, which are provided with upper and lower channel-shaped parts.

Figure 3:
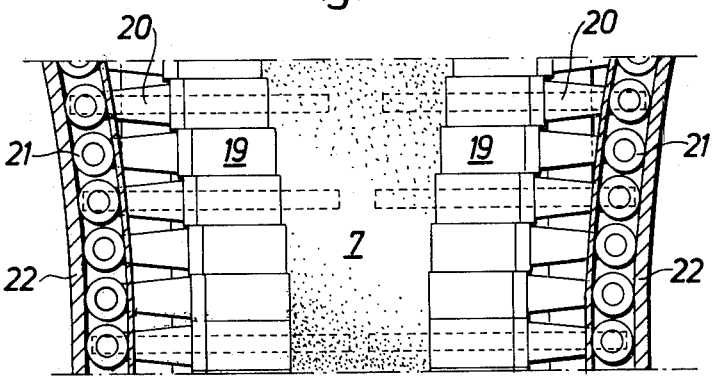
FIGS. 3 and 4 illustrate two alternative embodiments of side-pressing blocks for use with the press illustrated in FIG. 2.

As will be seen more clearly from FIG. 3 the guide rails 22 are curved, which means that the material stringer 7 is progressively pressed in a lateral direction when said stringer passes through the pressing zone. This lateral pressing of the stringer is preferably not commenced until the stringer has been given its desired final thickness, by pressing said stringer in the vertical direction.

For the purpose of conveying the side-pressing blocks 19 synchronously with the press belts 1 and 2, and in order to obtain accurate guiding of the blocks during said transverse movement relative to the press belts, 1,2 the holders 33 provided with said runners 21 are connected to horizontal shafts 23 which are displaceably mounted, by means of splined couplings in holes 24 in the mutually linked support plates forming the press chain 9. In this way accurate guiding and synchronous conveyance of the side-pressing blocks 19 is ensured. Since, in this way, the blocks are moved in a circuit in a path oriented in the vertical plane, the need of increasing the total width of the press is reduced to a minimum. Alternatively, guides for said shafts can be arranged on the upper surfaces of the respective mutually linked support elements, whereat said shafts will also serve as press arms, since then they will be directly connected to the side-pressing blocks.

Figure 4:
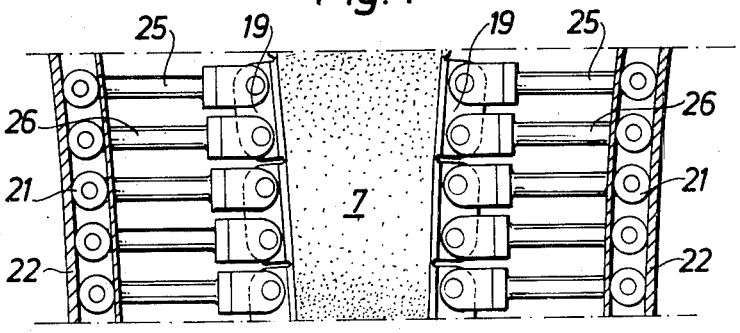

In FIG. 4 there is illustrated an alternative embodiment of the side-pressing blocks 19, which in this embodiment are longer than in the preceding embodiment, whereat each block is pivotally connected to two press arms 25 and 26. Each press arm is thus connected to a separate pair of runners 21 arranged to co-act with the guide rails 22. This embodiment affords a gentler action on the particles, for example the wood chips, in the edge regions of the stringer. In both embodiments of the side-pressing blocks 19, however, said blocks are arranged side by side so as to form an unbroken defining surface for the material stringer in a lateral direction. If desired, a press belt may be arranged between the side-pressing blocks 19 and the stringer 7.

Figure 5:
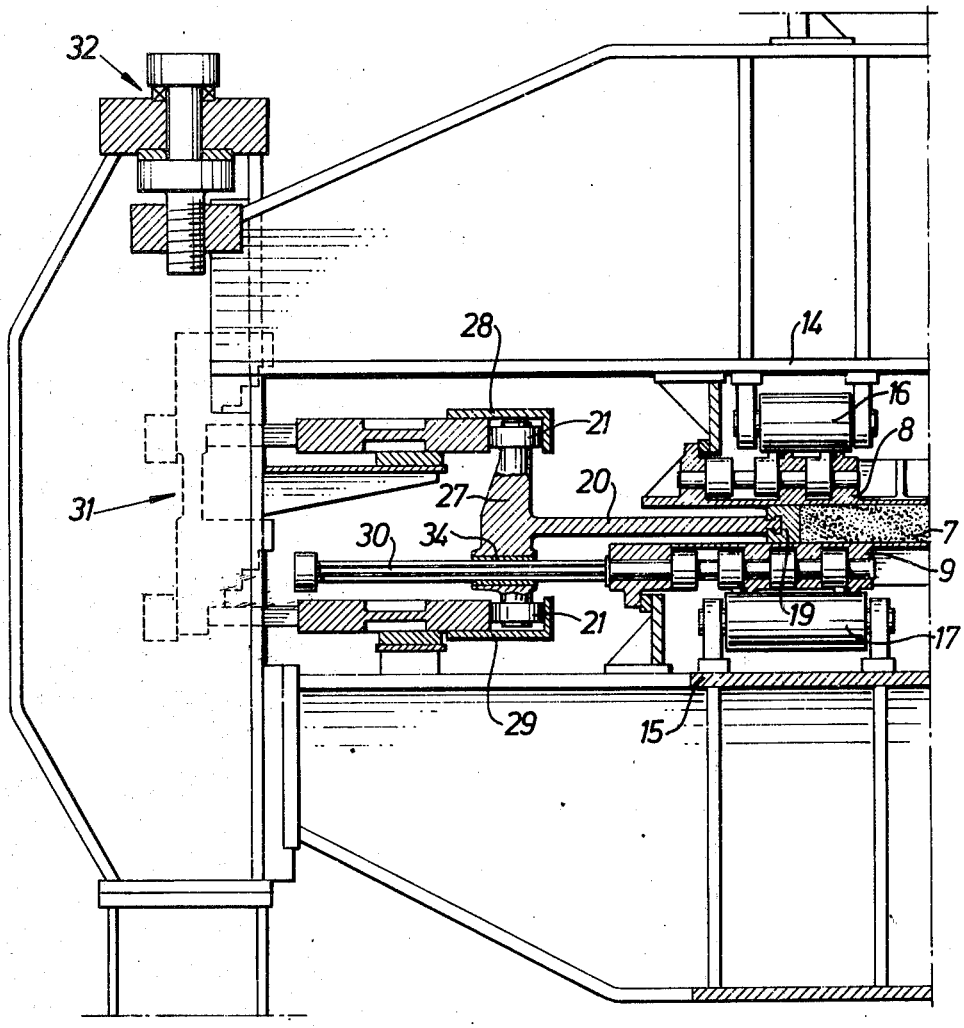
FIG. 5 is a sectional view of one half of a press with associated frame structure in accordance with an alternative embodiment.

FIG. 5 is a sectional view through one half of a press and its associated frame structure in accordance with an alternative embodiment of the press, in which the links forming the press chain 8 have substantially the same form as the links forming the press chain 9. A further difference is that in this embodiment there is used another form of guide for the side-pressing blocks 19. As with the FIG. 2 embodiment, displacement of the blocks 19 is also in this case caused by means of a press arm 20, which is connected with a holder 27 provided with two runners 21, each of which in this embodiment co-operate with a respective channel-shaped rail 28 and 29, respectively. When displacing the side-pressing blocks 19, the holder 27 is guided by means of a bearing 34 on a shaft 30, which is fixedly connected to an associated support plate of the press chain 9. The difference between the FIG. 2 embodiment and the FIG. 5 embodiment is that in the FIG. 2 embodiment the shaft 23 is displaced while in the FIG. 5 embodiment the holder 27 is displaced on a stationary shaft 30. The length of stroke and the space required is the same in both cases. Further, both embodiments afford good guidance of the side-pressing blocks over the whole of the length of stroke.

The press frame structure may be adjustable so as to enable chip stringers of different dimensions to be pressed. The assembly 31 illustrated schematically in FIG. 5 by broken lines enables the press to be adjusted to material stringers of different widths, while the assembly 32 is arranged to permit changes in press height. Since these assemblies have only been included to show that a press construction according to the invention enables the press to be readily adjusted to different dimensions, no further description of said assemblies will be given.

The aforedescribed embodiments are merely exemplary embodiments of the present invention, which can be modified in several respects within the scope of the accompanying claims. Thus, the side-pressing blocks may be conveyed and guided by the upper chain 8 instead of by the lower chain 9, as shown in the drawings. Neither is the press according to the invention limited to the pressing of a chipboard beam in accordance with the aforementioned U.S. patent specification, but can also be used for pressing continuous stringers of any desired material, where pressing forces are to be applied in two mutually perpendicular directions. The press according to the invention is well suited for use as a pre-press for wood chip products which can be connected directly to a hardening press. In this respect, the lower press belt may optionally be arranged to serve both presses. The press belts may also be omitted if the links forming the press chains can be arranged in such close relationship as to provide a chain which is sufficiently smooth for the purpose in question.

What is claimed is:

1. A continuously working press for forming a continuous stringer of compressed material, comprising:

upper and lower continuously moving endless press chains formed by mutually linked support elements for pressing the stringer material in a vertical direction;

means for supporting said press chains;

two arrays of side-pressing blocks for pressing said stringer material in a lateral direction;

means for moving said arrays of side-pressing blocks in a transverse direction of the press chains and towards each other between the press chains;

means for guiding said side-pressing blocks during said transverse movement, said guiding means being conveyed by said support elements forming said press chains.

2. The press of claim 1 wherein said side-pressing blocks are conveyed in a circular motion of the upper or lower press chain, and further comprising guide rails arranged on sides of the press chains which co-act with said blocks to guide said blocks in said transverse direction.

3. The press of claim 1 further comprising at least one shaft and an associated support element connected to each side-pressing block, and means for displaceably mounting said at least one shaft to said associated support element.

4. The press of claim 1 further comprising means for displaceably mounting each side-pressing block, said means for displaceably mounting each side-pressing block comprising at least one shaft and an associated support element, said at least one shaft projected outwardly from said associated support element.

5. The press of claim 1, wherein said guide rails are so constructed that lateral pressing of the material stringer is not commenced until the desired thickness of the stringer has substantially been obtained by pressing said stringer in the vertical direction.

6. The press of claim 1 further comprising a plurality of press arms and a plurality of runners arranged to co-act with an associated support rail, each side-pressing block being connected to at least one of said press arms into at least one of said runners.

7. The press of claim 6, wherein each side-pressing block is pivotally connected to two press arms which are arranged side by side and each of which is connected to at least one runner arranged to co-act with an associated guide rail.

8. The press of claim 6, wherein each press arm is connected to two runners each of which is arranged to co-act with a guide rail.

* * * * *